US005369946A

United States Patent [19]

Pujol-Isern

[11] Patent Number: 5,369,946

[45] Date of Patent: Dec. 6, 1994

[54] CONTINUOUS CENTRIFUGAL SPINNING METHOD AND SPINNING FRAME FOR PRACTICING THE METHOD

[76] Inventor: Carlos Pujol-Isern, Calle Vergos 54, 08017 Barcelona, Spain

[21] Appl. No.: 15,823

[22] Filed: Feb. 10, 1993

[30] Foreign Application Priority Data

Feb. 14, 1992 [EP] European Pat. Off. ..... 92500015.0

[51] Int. Cl.[5] ..... D01H 5/28; B65H 54/02

[52] U.S. Cl. ..... 57/312; 57/313; 242/35.5 A

[58] Field of Search ..... 57/76, 76, 264, 266, 57/281, 312, 313; 242/35.5 A

[56] References Cited

U.S. PATENT DOCUMENTS

| | | | |
|---|---|---|---|
| 3,111,804 | 11/1963 | Beyer | 57/76 |
| 3,343,358 | 9/1967 | Nussbaum | 57/76 |
| 3,434,272 | 3/1969 | Aoe et al. | 57/76 |
| 3,903,681 | 9/1975 | Bous | 57/313 |
| 4,703,617 | 11/1987 | Engeli et al. | 57/264 X |
| 5,010,724 | 4/1991 | Rebsamen | 57/281 X |
| 5,016,434 | 5/1991 | Kamp | 57/313 |
| 5,170,617 | 12/1992 | Rebsamen | 57/313 X |

FOREIGN PATENT DOCUMENTS

| | | | |
|---|---|---|---|
| 515762 | 12/1992 | European Pat. Off. | 57/312 |
| 502762 | 6/1981 | Spain . | |
| 2231886A | 11/1990 | United Kingdom . | |

*Primary Examiner*—Daniel P. Stodola
*Assistant Examiner*—Michael R. Mansen
*Attorney, Agent, or Firm*—Nixon & Vanderhye

[57] ABSTRACT

A centrifugal spinning apparatus, comprises a plurality of drawing mechanisms for simultaneously producing a plurality of fiber tows and a plurality of spinning units forming an assembly of such units operating in synchronism, each spinning unit being associated with a respective drawing mechanism and comprising a pair of centrifugal spinning pots associated with respective temporary storage bobbins. Each drawing mechanism alternately supplies two spinning pots. On changing pots, the yarn is severed and its end is picked up by a temporary storage bobbin. A carriage, displaceable along a guide, carries a yarn suction arm pivotally mounted about shaft, a joining device, a reserve yarn bobbin system, and a take-up bobbin. The carriage is moved opposite storage bobbins of the different spinning systems associated with the several drawing mechanisms. The reserve yarn bobbin system ensures the continuity of the winding of the yarn on the bobbin during the displacement of the carriage and the joining of the two ends of the yarn by the joining device so that a continuous yarn is produced on the take-up bobbin and wound at a speed which is a multiple of the speed of each drawing mechanism.

11 Claims, 5 Drawing Sheets

5a
17A
20A
26
24
27
18A
19A
11
28
22
21A
25
5b
30
15
29
32
33
A
13
23
C 1
6a
16B
5a
16A
6a
16B
5a
16A
20B
21A'
20A
21B'
20B
26
22
12
21A
11
21B
25
5b
28
29
15
32
13
30
6b
14
31
A
A
B
33
B
A
23
C 1
8
8
7
9
10
6a
5a
16B
16A
18B
20B
18A
26
20A
27
22
12
11
5b
29
13
15
30
6b
14
32
6b
33
B
A
23
C

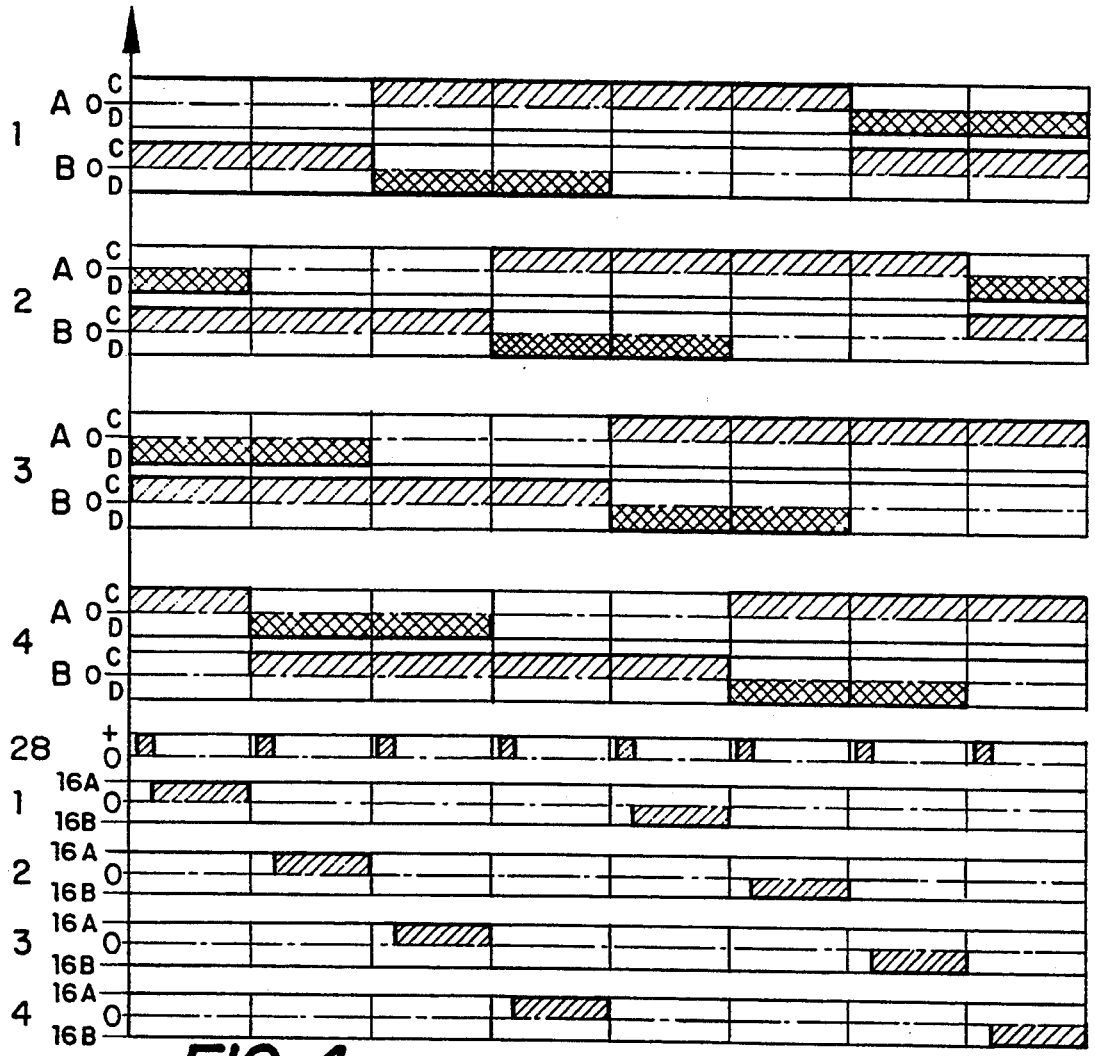
FIG. 4a
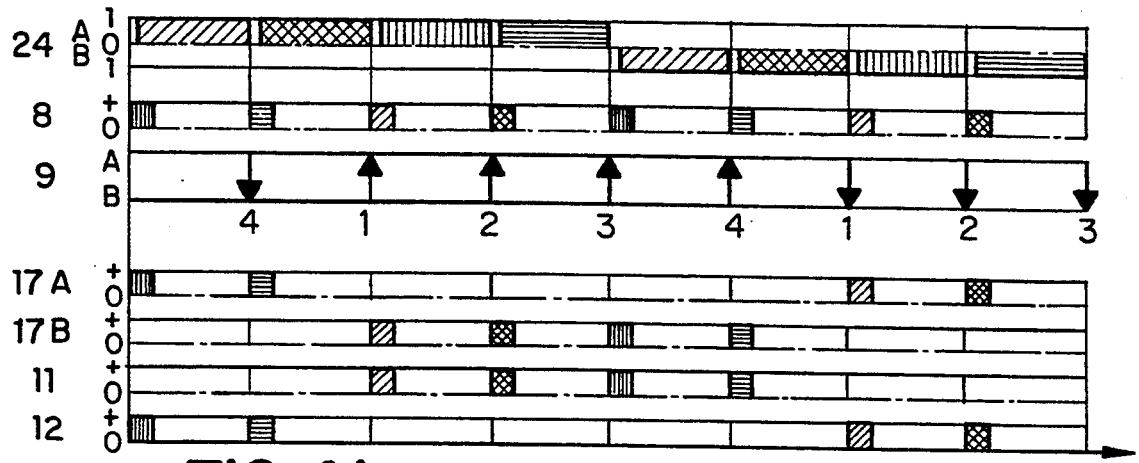
FIG. 4b
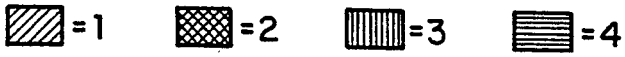

CONTINUOUS CENTRIFUGAL SPINNING METHOD AND SPINNING FRAME FOR PRACTICING THE METHOD

BACKGROUND OF THE INVENTION

This invention relates to a centrifugal spinning method for continuously producing yarn, according to which two centrifugal spinning pots are alternatively supplied from a drawing mechanism.

In such a method, a fiber tow is severed between the drawing mechanism and one of the spinning pots, and directed to the other pot where the cycle is repeated. A length of yarn is alternately removed from each of the two centrifugal spinning pots and stored, each length of stored yarn being then successively retrieved and its leading free end attached to the rear free end of the preceding length of yarn, of which a portion is stored on a intermediate reserve yarn bobbin system. The yarn which continuously leaves this system and at a constant speed is wound onto a bobbin. The invention also relates to an apparatus for carrying out the method.

DESCRIPTION OF THE PRIOR ART

It is known that centrifugal spinning is capable of producing a yarn having a quality equal to that of a ring traveler system, or even better quality, and at speeds which can be substantially greater given the elimination of the friction problems associated with the traveler.

One of the principal disadvantages of centrifugal spinning is that it is in principle discontinuous and only capable of producing lengths of yarn very much less than necessary to form a standard bobbin.

Spanish Patent No. 502 762 describes a centrifugal spinning system comprising two spinning pots per drawing mechanism and a storage member in which the yarn produced in one pot is stored while the other pot is filled. The lengths of stored yarn are wound onto a bobbin and then joined together to form a continuous yarn. An intermediate reserve yarn bobbin system allows continuous winding onto a bobbin and the joining together of the lengths of yarn.

The disadvantage of such a system stems from the fact that the bobbin winding speed is limited to that of the drawing mechanism. Even though the centrifugal spinning permits an increase in the spinning speed relative to ring traveler spinning, this speed is still low for bobbin winding.

An object of the present invention is to permit the above-mentioned disadvantage to be at least partially overcome.

SUMMARY OF THE INVENTION

In a first aspect the invention provides a method of continuously producing yarn by centrifugal spinning, comprising simultaneously feeding a plurality of fiber tows to respective centrifugal spinning units forming an assembly of such units, each unit comprising a pair of centrifugal pots with associated temporary storage bobbins that store a length of spun yarn ready for retrieval; in each spinning unit, alternately spinning a predetermined length of yarn in one centrifugal pot while temporarily storing a spun length of yarn formed in the other pot on its associated temporary storage bobbin, and vice versa, the successive spinning units of the assembly operating in synchronism but shifted in phase such that the lengths of spun yarn on the temporary storage bobbins of the assembly are ready for retrieval during successive different time intervals during each cycle of operation of the assembly; moving along the assembly of spinning units during each cycle of operation of the assembly to successively retrieve lengths of spun yarn from the temporary storage bobbins; and joining the retrieved lengths into a continuously supplied spun yarn.

In a preferred embodiment, n such fiber tows are fed to said respective units at the substantially the same speed M, the speed of production of said continuous spun yarn is substantially equal to $n \times v$, and the phase shift between the successive units of the assembly is equal to the duration of a cycle of operation of each individual spinning unit divided by 2n.

By simultaneously spinning yarn in a plurality of spinning units operating in synchronism and joining the lengths of spun yarn into a continuous length, the method can operate at speeds considerably greater than are possible with a single spinning unit.

In order to improve efficiency, the individual cycles of operation of each spinning unit can occur in an order that is different from their adjacent order. In this way the distance that must be traveled between each successive retrieval from a temporary storage bobbin can be reduced.

The invention also provides a centrifugal spinning apparatus, comprising a plurality of drawing mechanisms for simultaneously producing a plurality of fiber tows; a plurality of spinning units forming an assembly of such units operating in synchronism, each spinning unit being associated with a respective drawing mechanism and comprising a pair of centrifugal spinning pots associated with respective temporary storage bobbins; at each spinning unit, distributing means for severing the tow into lengths and alternately directing the severed lengths into one of the centrifugal pots where it is spun into yarn, while the spun yarn from the other pot is stored on its associated temporary storage bobbin, and vice versa during each cycle of the individual spinning units; means for controlling the operation of the spinning units of the assembly such that their individual cycles are shifted in phase to ensure that the spun yarn on the temporary storage bobbins is ready for retrieval during successive time intervals during each cycle of operation of the assembly; means for successively retrieving the lengths of spun yarn from the individual spinning units during each cycle of operation of the assembly; and means for joining the retrieved lengths into a continuous yarn supplied at a speed greater than the speed of production than an individual unit.

The distributing means of the centrifugal spinning apparatus hereof also includes respective conduits leading to the respective pots of the spinning unit associated therewith, said conduits being divided into two separate portions with a gap therebetween, said gap being proximate a roller providing a said temporary storage bobbin, and assist means being provided to assist in the picking up of the severed end of the length of yarn by said roller.

BRIEF DESCRIPTION OF THE DRAWINGS

The invention will now be described in more detail, by way of example only, with reference to the accompanying drawings, in which:

FIG. 4*a* is a diagram of the sequence of operations carried out in the process;

FIG. 4*b* is a diagram showing the various operational phases of the spinning frame;

DESCRIPTION OF THE PREFERRED EMBODIMENTS

Figure 1:
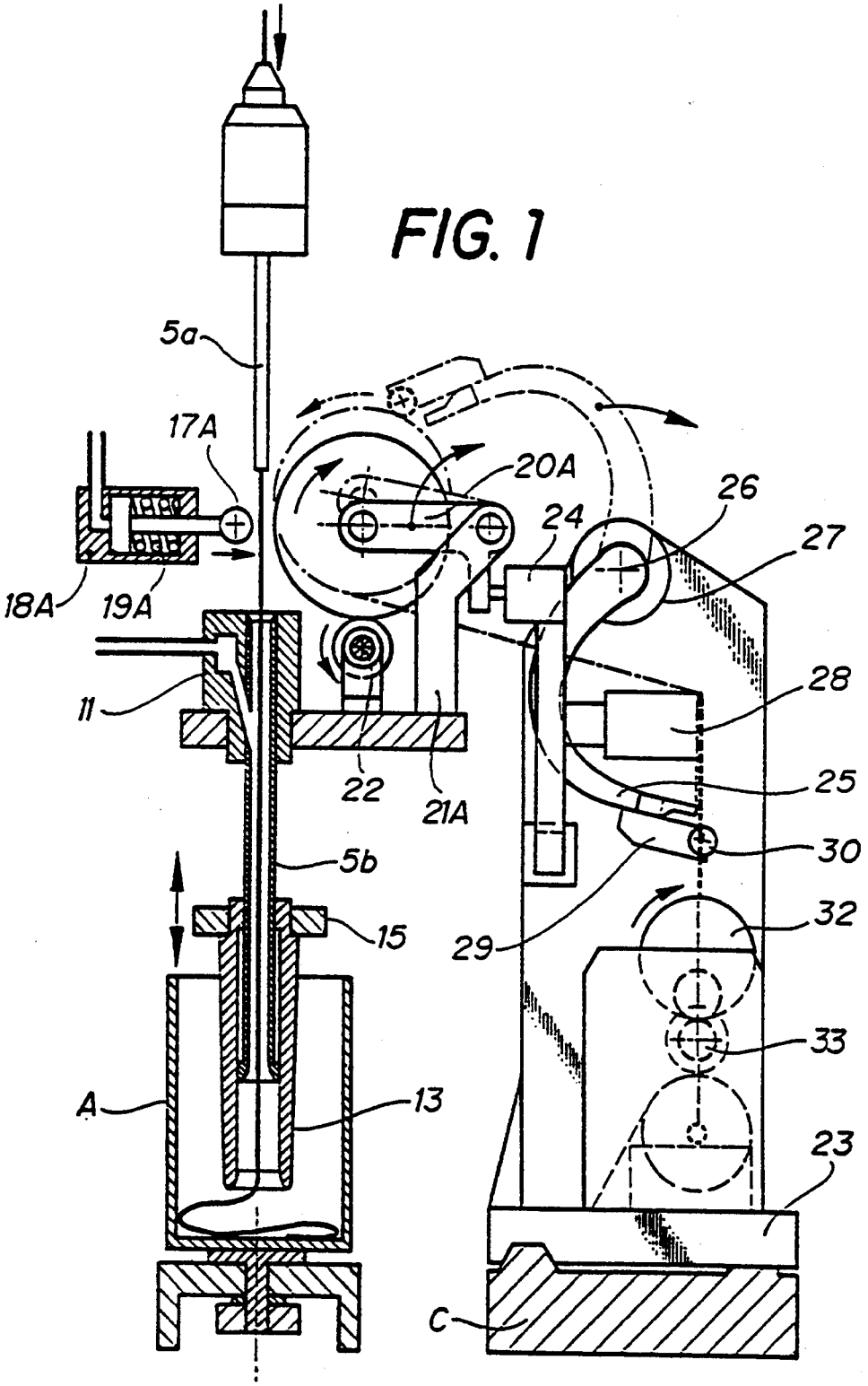
FIG. 1 is a side elevation of the spinning frame.
Figure 2:
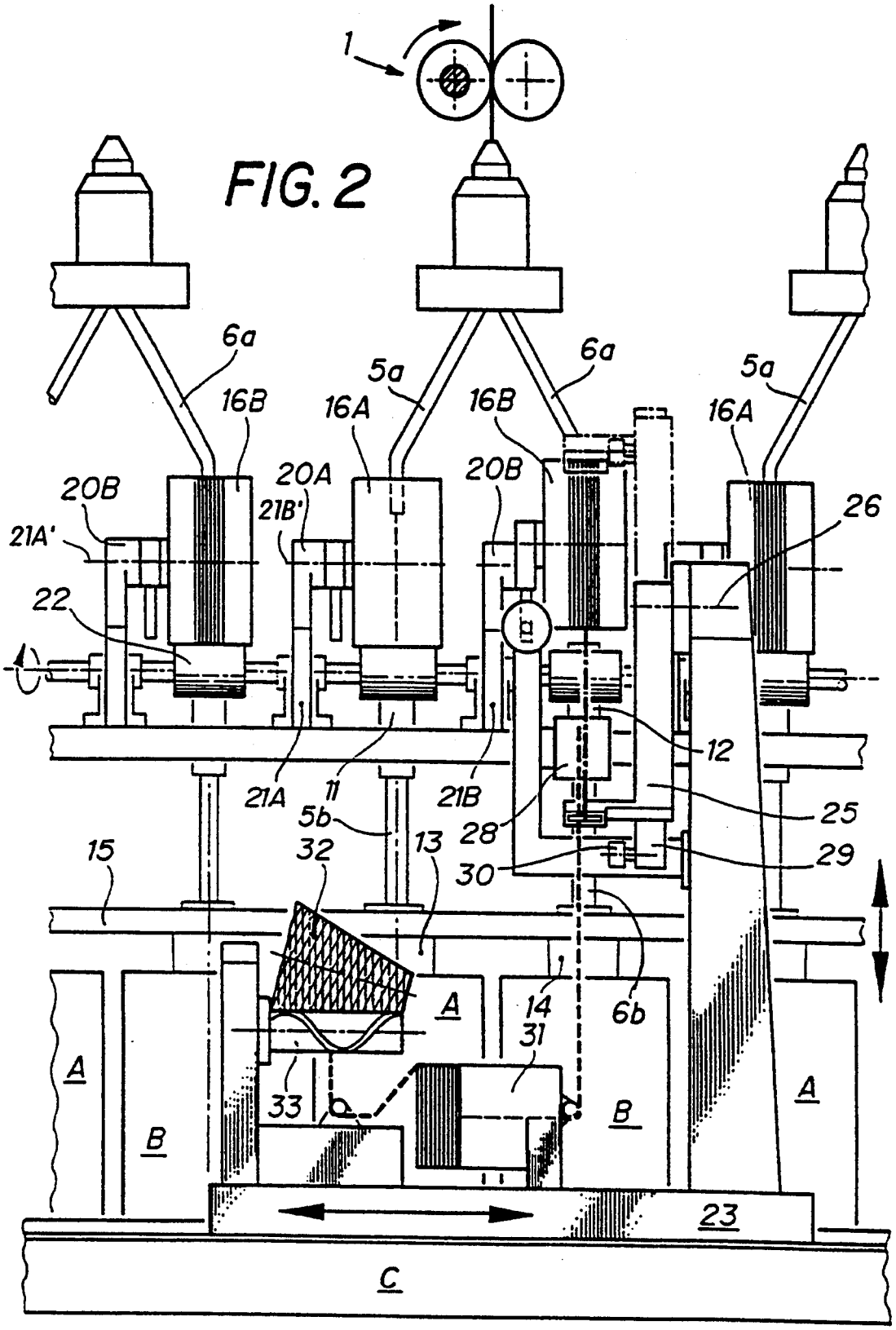
FIG. 2 is a front elevation of FIG. 1 with only a single spinning unit completely illustrated.
Figure 3:
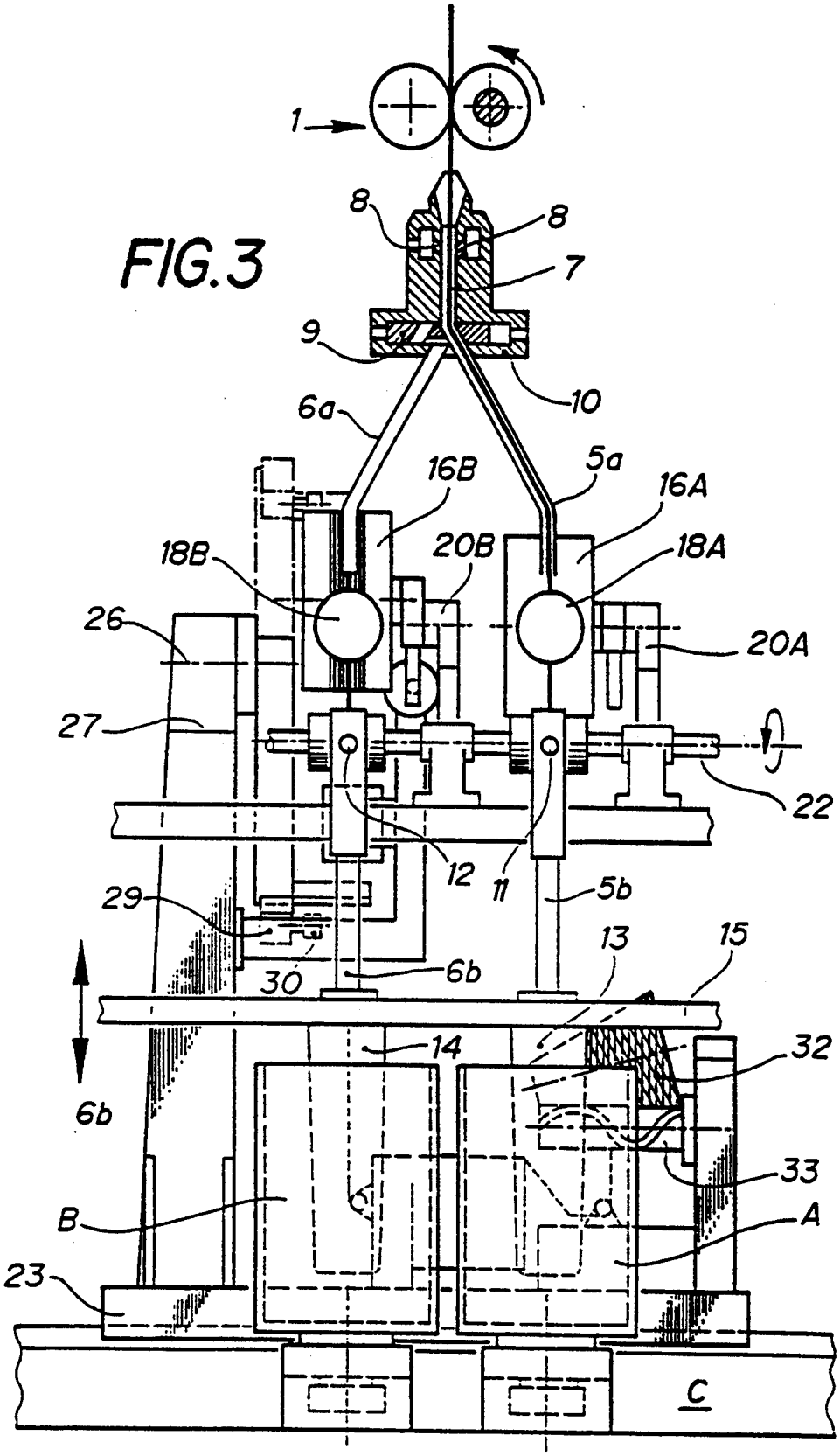
FIG. 3 is a rear elevation of FIG. 2.

The spinning frame illustrated in FIGS. 1 to 3 shows only the outlet of drawing mechanism 1 for the purpose of simplification, the other drawing mechanisms 2, 3, 4 appearing in the diagram of FIGS. 4*a* and 4*b*, which shows the complete spinning system according to the invention, comprising at least two spinning units.

Each drawing mechanism is associated selectively with two centrifugal spinning pots A and B by two conduits, of which each is divided into two parts 5*a*, 5*b* and 6*a*, 6*b* respectively. The two parts of the conduits 5*a*, 6*a* converge into a common conduit 7 (FIG. 3) which opens at the outlet of the drawing mechanism 1. Channels 8 connected to a source of air under pressure (not shown) open into conduit 7 and are oriented so as to induce a forward spiral movement in the fiber ribbon leaving the drawing mechanism and thus impart to it a pre-twist. A piston 9 is mounted in a recess 10 of which the two ends are selectively connected to an air source under pressure to alternately push the piston 9 from one end to the other of the recess 10, thus alternatively establishing communication between the conduit 7 and the conduits 5*a*, 6*a* and severing the yarn at the same time. The details of this system are described in European Patent Application 91500048.3. A gap is provided between the conduits 5*a*, 5*b* and 6*a*, 6*b* (FIG. 1). An injector 11, respectively 12, is provided at the entrance of each conduit part 5*b*, 6*b* for aspirating the freed end of the yarn upon each change of spinning pot. The outlet of each conduit 5*b*, 6*b* is integral with a telescopic tube 13, respectively 14, fixed to a slider 15 driven in an alternating vertical movement permitting the distribution of yarn against the lateral wall of the pots A and B.

At the level of the gap separating the conduit parts 5*a*, 5*b* and 6*a*, 6*b* is located, on one side of the path of the yarn between the conduits 5*a*, 5*b* and 6*a*, 6*b*, a storage bobbin 16A respectively 16B and, on the other side of this path pushers, only one of which is illustrated at 17A comprising an idle wheel rotatably mounted on the end of the piston rod mounted in cylinder 18A, respectively 18B, connected to a source of fluid under pressure (not shown) and biased by springs, only one of which is illustrated at 19A. Each storage bobbin 16A, 16B is pivoted about an elbow arm 20A, respectively 20B, articulated about a support 21A, respectively 21B, and resting by its own weight on a drive shaft 22. The surface of these storage bobbins is roughened or covered with a substance for catching the yarn. The surface of these bobbins can also be perforated, the interior of the bobbins being thus connected to a source of suction for retaining the yarn when the pushers 17A, 17B apply the severed end of the yarn against its surface.

A carriage 23 is slidably mounted in a slider C integral with the framework of the spinning frame and extending parallel to the different spinning units associated with each drawing mechanism such that the carriage 23 can be brought into opposition with each storage bobbin 16A, 16B of several spinning units.

The carriage 23 comprises a piston 24 (FIG. 1) situated opposite the elbow arms 20A, 20B and arranged to pivot these elbow arms about articulation axes 21A', respectively 21B', to separate the storage bobbins 16A, 16B from the drive arm 22. A suction arm 25 is articulated on the carriage about a shaft 26, a drive motor 27 being arranged to displace it between the two extreme positions illustrated in FIG. 1 in order to extract the end of the yarn from the storage bobbin 16A, 16B and lead it to a known device 28 for joining the fibers by twisting, not shown here in detail, this device strictly speaking not forming part of the present invention. The suction arms 25 carry a drive device 29 for the storage bobbins 16A, 16*b* comprising an idle wheel 30 adapted to bear against a storage bobbin when the suction arm 25 is in the position shown in broken lines in FIG. 1. This idle wheel 30 is adapted to rotate the storage bobbin approximately one revolution in order to leave the end of the yarn wound on this bobbin opposite the suction entrance of the suction arm 25.

The carriage 23 additionally carries an intermediate reserve yarn bobbin device 31 having an output feeding a bobbin 32 mounted on the carriage 23 and in engagement with a drive shaft 33.

The different devices mounted on the carriage are known, such that they are not described in detail here, the person skilled in the art being familiar with each of them.

With the aid of the operational sequence and function diagrams of FIGS. 4*a* and 4*b*, an explanation will be given, by way of example, as to how a continuous yarn, wound at constant speed on the bobbin 32, can be obtained from yarn produced by centrifugal spinning systems supplied, in this example by four drawing mechanisms.

In this diagram, on the abscissa is shown the duration of a complete spinning cycle corresponding to the filling time of the two pots A and B of the four spinning systems, and on the ordinate, from top to bottom the filling functions C and emptying functions D of the pots A and B of the storage bobbins 16A, 16B of the four spinning systems 1, 2, 3, 4. Next, this diagram shows the operation of the joining device 28, which works by twisting the fibers of the yarn, and then the removal of the yarn from the storage bobbin 16A, 16B of the four spinning systems 1, 2, 3, 4. The diagram in FIG. 4*b* shows the raising of the storage bobbins A and B, i.e. the operation of the piston 24. The raising of the bobbins 16A, 16B of the different spinning systems 1, 2, 3, 4 is shown in four types of hatching, which are used for all the operations that follow while so far only two types of hatching have been used to distinguish the loading operations C and discharge operations D of the yarn from pots A and B.

With regard to the disengagement of the storage bobbins by the piston 24, it should be noted that there is a time interval between the successive disengagements of the two bobbins. This interval is intended to permit the displacement of the carriage 23 from one storage bobbin 16 to another operation that is not shown in the diagram.

The following operation relates to the different channels 8 designed to induce the pretwisting in the yarn exiting the drawing mechanisms 1, 2, 3 and 4. The operation of the channels 8 of the different spinning systems supplied by the drawings mechanisms 1, 2, 3, 4 is identified by different hatchings. Next, the path of the piston 9 from the opening of the conduit 5*a* supplying the spinning pot A to the opening of the conduit 6*a* supplying the pot B and vice versa is shown by arrows pointing in opposite directions. Each arrow is numbered from 1 to 4 to permit identification of the spinning system in question. The two following operations apply to yarn pushers 17A and 17B, which are synchronized with the severing of the yarn by the passage of the piston 9 from one position to the other, the different spinning systems being identified by different hatchings. Finally, the two last operations shown are those relating to injectors 11 and 12, which are synchronized with the severing of the thread and arranged to re-introduce the freed ends into the conduit parts 5*b* and 6*b*.

To obtain a continuous production of the yarn with the four spinning systems of the diagram shown in FIG. 4, the winding speed on bobbin 32 must correspond to four times that of each drawing mechanism 1, 2, 3, 4. To ensure continuity, the alternation between the spinning pots A and B of the different spinning systems 1, 2, 3, 4 must be phase shifted by the length of the spinning cycle divided by two times the number of spinning systems or, which amounts to the same thing, by the number of spinning parts utilized to produce the yarn.

Of course, the number of spinning units utilized to produce a continuous yarn can be less than or greater than the four given by way of example.

In this example, the carriage 23 successively removes the yarn from bobbins 16A of the spinning systems 1, 2, 3, 4, then returns to bobbin 16B of the spinning system 1 and removes the yarn from bobbins 16B of the spinning systems 2, 3, 4. The disadvantage with this sequence stems from the fact that the carriage 23 must return from the last spinning system to the first, which constitutes a long path for the carriage 23. To reduce the length of the longest path of the carriage 23, the sequence of operation can be changed by modifying the timing of the phase shift between the spinning systems. Thus, in the case for example of FIG. 4, it is advantageous to establish a phase shift of ⅛ of a cycle (corresponding to the length of the cycle divided by 2n, n being the number of spinning systems) between the switching from the spinning pots A to the spinning pots B of the spinning systems 1, 3, 4 and 2, and then to use same phase shift timing for the switching from spinning pots B to spinning pots A.

Figures 5A, 5B:
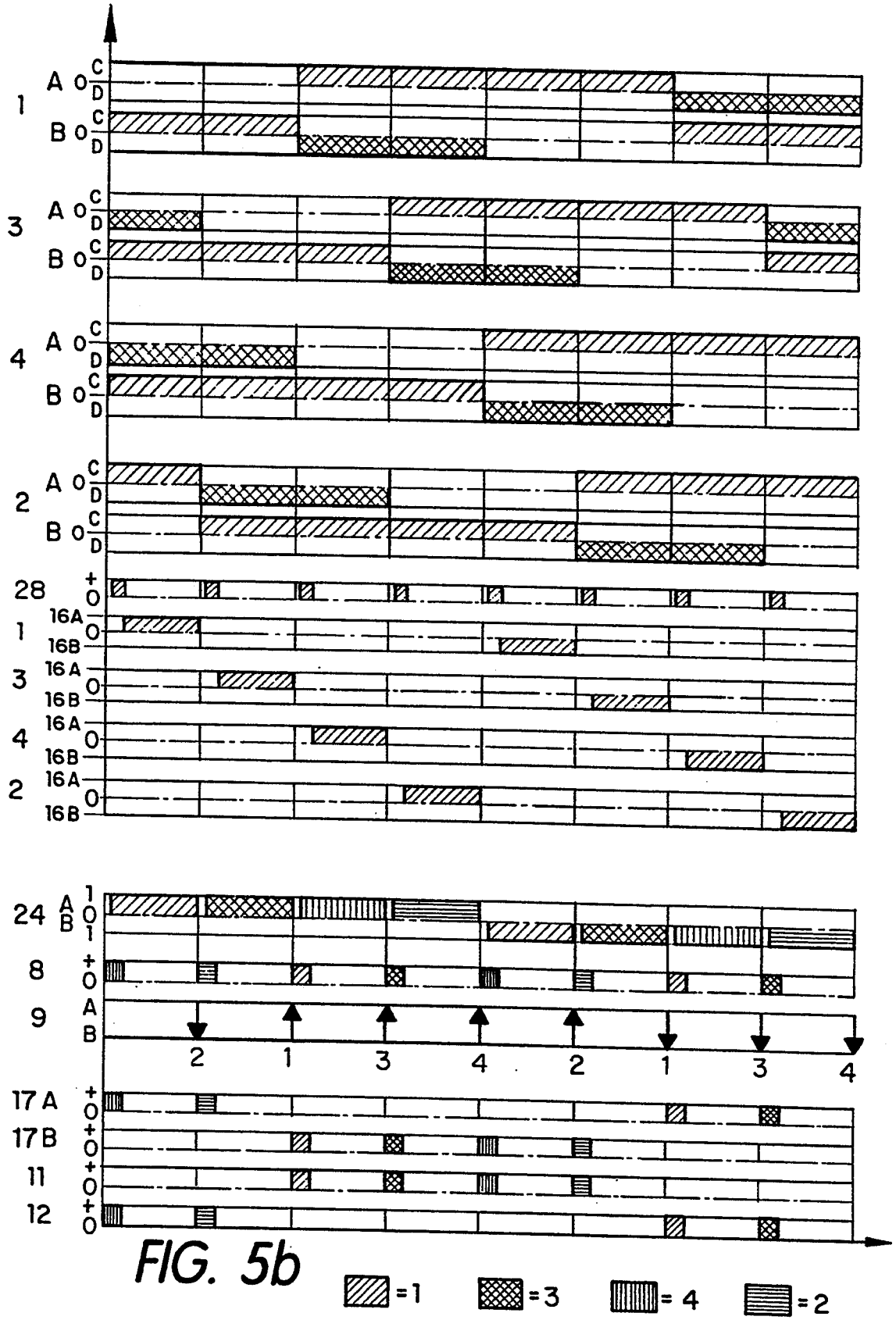
FIGS. 5*a* and 5*b* are diagrams of the sequence of operation and operational phases similarly as set forth in FIGS. 4*a* and 4*b* illustrating the individual cycles of operation of each spinning unit occurring in an order different from the order of their adjacency.

Consequently, the carriage 23 can in this case successively remove the yarn from bobbins 16A of the systems 1, 3, 4 and 2, and then the yarn of bobbin 16B of the systems 1, 3, 4 and 2 as set forth in the diagrams of FIGS. 5*a* and 5*b*. This timing results in the longest course of the carriage 23 being reduced relative to the example shown in FIG. 4. It is true that with four spinning systems this reduction is small, but if the number of systems to produce the continuous yarn on bobbin 32 is increased, it becomes important to use this arrangement to avoid the need for the carriage to return from the last spinning system to the first in the same movement.

As will be apparent from the diagram of FIG. 4, the reserve yarn bobbin device is not supplied during the displacement of the carriage and during the joining of the two lengths of yarn, such that the reserve yarn accumulated in the device 31 will be sufficient to supply the bobbin 32 during this period.

I claim:

1. A method of continuously producing yarn by centrifugal spinning, comprising:

a) simultaneously feeding a plurality of fiber tows to respective centrifugal spinning units forming an assembly of such units, the assembly of spinning units having a cycle of operation, each unit comprising a pair of centrifugal pots with associated temporary storage bobbins that store a length of spun yarn ready for retrieval;

b) in each spinning unit, alternately spinning a predetermined length of yarn in one centrifugal pot while temporarily storing a spun length of yarn formed in the other pot on its associated temporary storage bobbin, and vice versa, providing an identical operating cycle for each spinning unit, the operating cycles of spinning units of the assembly being shifted in phase such that the lengths of spun yarn on the temporary storage bobbins of the assembly are ready for retrieval during successive different time intervals during each cycle of operation of the assembly;

c) moving along the assembly of spinning units during each cycle of operation of the assembly to successively retrieve lengths of spun yarn from the temporary storage bobbins; and d) joining the retrieved lengths into a continuous spun yarn.

2. A method as claimed in claim 1, wherein n said fiber tows are fed to said respective units at substantially the same speed v, the speed of production of said continuous spun yarn is substantially equal to $n \times v$, and the phase shift between the successive units of the assembly is equal to the duration of said operating cycle for each individual spinning unit divided by 2n.

3. A method as claimed in claim 1, wherein during each cycle of operation of the assembly, the lengths of spun yarn are retrieved successively from one of the pots of each spinning unit, and then from another of the pots of each spinning unit.

4. A method as claimed in claim 1, wherein the spinning units are disposed adjacent one another in a predetermined order, and the individual cycles of operation of each spinning unit occur in an order that is different from their adjacent order to reduce the distance traveled between each successive retrieval from a temporary storage bobbin,

5. A centrifugal spinning apparatus, comprising:

a) a plurality of drawing mechanisms for simultaneously producing a plurality of fiber tows;

b) a plurality of spinning units forming an assembly of such units with the spinning units having identical operating cycles, the assembly of spinning units having a cycle of operation, each spinning unit being associated with a respective drawing mechanism and comprising a pair of centrifugal spinning pots and temporary storage bobbins, the spinning pots being associated with respective temporary storage bobbins;

c) at each spinning unit, distributing means for severing the tow into lengths and alternately directing the severed lengths into one of the centrifugal pots where it is spun into yarn, while the spun yarn from the other pot is transferred to and stored on its associated temporary storage bobbin, and vice versa during each cycle of operation of the individual spinning units, each spinning unit forming the spun yarn at a predetermined production rate;

d) means for controlling the operation of the spinning units of the assembly such that the operating cycles of the spinning units are shifted in phase to ensure that the spun yarn on the temporary storage bobbins is ready for retrieval during successive time intervals during each cycle of operation of the assembly;

e) means for successively retrieving the lengths of spun yarn from the individual spinning units during each cycle of operation of the assembly; and f) means for joining the retrieved lengths into a continuous yarn at a speed greater than the predetermined production rate of each spinning unit.

6. A centrifugal spinning apparatus as claimed in claim 5, wherein said distributing means includes respective conduits leading to respective pots of the spinning unit associated therewith, each said conduit being divided into two separate portions with a gap therebetween, one of said temporary storage bobbins lying proximate said gap, and assist means for picking up a severed end of a length of yarn by said one bobbin.

7. A centrifugal spinning apparatus as claimed in claim 6, wherein said assist means comprise a pusher member operable to urge the severed end of the length of yarn against said bobbin during pick-up.

8. A centrifugal spinning apparatus as claimed in claim 5, wherein said means for successively retrieving the lengths of spun yarn comprises a carriage mounted on guide means and displaceable past said spinning units, and means for displacing the carriage in accordance with the individual operating cycles of the spinning units.

9. A centrifugal spinning apparatus as claimed in claim 8, including an intermediate reserve yarn bobbin and a final take-up bobbin mounted on said carriage, said intermediate reserve yarn bobbin ensuring continuity of supply from said joining means to said final take-up bobbin.

10. A centrifugal spinning apparatus as claimed in claim 9, further comprising an injector member at an entrance of a lower conduit portion of each conduit for drawing a leading end of the severed length of tow into the centrifugal spinning pot at a beginning of each centrifugal spinning operation.

11. A centrifugal spinning apparatus as claimed in claim 10, wherein said injector comprises an inclined channel for directing air into said lower part of each conduit for creating a suction effect at the entrance thereof.

* * * * *